United States Patent [19]

Godwin

[11] Patent Number: 4,657,517

[45] Date of Patent: Apr. 14, 1987

[54] APPARATUS FOR AIDING THE ANCHORING OF A BOAT

[76] Inventor: W. Lee Godwin, Box 222-E, Blountstown, Fla. 32424

[21] Appl. No.: 864,253

[22] Filed: May 19, 1986

[51] Int. Cl.[4] ..... B63B 22/00

[52] U.S. Cl. ..... 441/1; 441/26; 73/188

[58] Field of Search ..... 114/294, 230; 441/1, 441/6, 23–27; 73/170 A,188

[56] References Cited

U.S. PATENT DOCUMENTS

| | | | |
|---|---|---|---|
| 385,323 | 6/1888 | Rust | 441/26 |
| 477,745 | 6/1892 | Eaton | 114/294 |
| 2,939,125 | 5/1960 | Swanson | 73/188 |
| 3,408,669 | 11/1968 | Mott | 441/6 |
| 4,307,605 | 12/1981 | Niskin | 73/188 |
| 4,405,303 | 9/1983 | Smith | 441/25 |
| 4,501,563 | 2/1985 | Johnson et al. | 441/6 |

*Primary Examiner*—Joseph F. Peters, Jr.
*Assistant Examiner*—Stephen P. Avila
*Attorney, Agent, or Firm*—Norman B. Rainer

[57] ABSTRACT

An apparatus is provided for helping to ascertain the precise site at which a boat anchor should be dropped in order to secure a sought position of the anchored boat. The apparatus is comprised of a floating reel member having a spool which holds a length of line. A weight having a streamlined contour is attached to the free end of the line. A visibly distinctive buoy is attached to the reel by a tether line. When the apparatus is thrown into the water, the weight rapidly sinks to the bottom, whereupon no further line leaves the spool. The buoy indicates the location the boat would have relative to its anchor as represented by the streamlined weight.

4 Claims, 3 Drawing Figures

APPARATUS FOR AIDING THE ANCHORING OF A BOAT

BACKGROUND OF THE INVENTION

This invention relates to the anchoring of boats, and more particularly concerns apparatus which aids the boat operator in the placement and retrieval of the boat's anchor.

The anchoring of a boat above a precise location is often made difficult by the effects of currents and wind which may unpredictably change the position of the boat during the period of time required for the anchor to make its descent. Although many systems and devices to expedite precise boat anchoring have earlier been disclosed, such earlier efforts have generally involved expensive components or complex features difficult to operate.

It is accordingly an object of the present invention to provide apparatus for indicating a precise location at which it is desired to drop an anchor.

It is another object of this invention to provide apparatus as in the foregoing object which further indicates the location a boat would have if anchored at said precise location and moved pivotally about its anchor by prevailing wind and current.

It is a further object of the present invention to provide apparatus of the aforesaid nature which can be quickly and easily operated.

It is still another object of this invention to provide apparatus of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by an apparatus for aiding the anchoring of a boat comprising:

(a) a floating reel member comprising a housing having a top portion and sidewall portions, a doubly flanged spool mounted in said sidewall portions and positioned to rotate about a horizontal axis, a continuous length of monofilament line attached to said spool and spirally wound thereupon, a crank handle protruding from said sidewall portions and extending therethrough to operative engagement with said spool, and visibly distinctive flotation means mounted upon said top portion, (b) a weight of streamlined elongated contour attached to the free extremity of said line and sufficiently heavy to cause rapid deployment of said line from said spool, and (c) a visibly distinctive current-indicating buoy attached to said housing by a tether line of 5–15 foot length.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
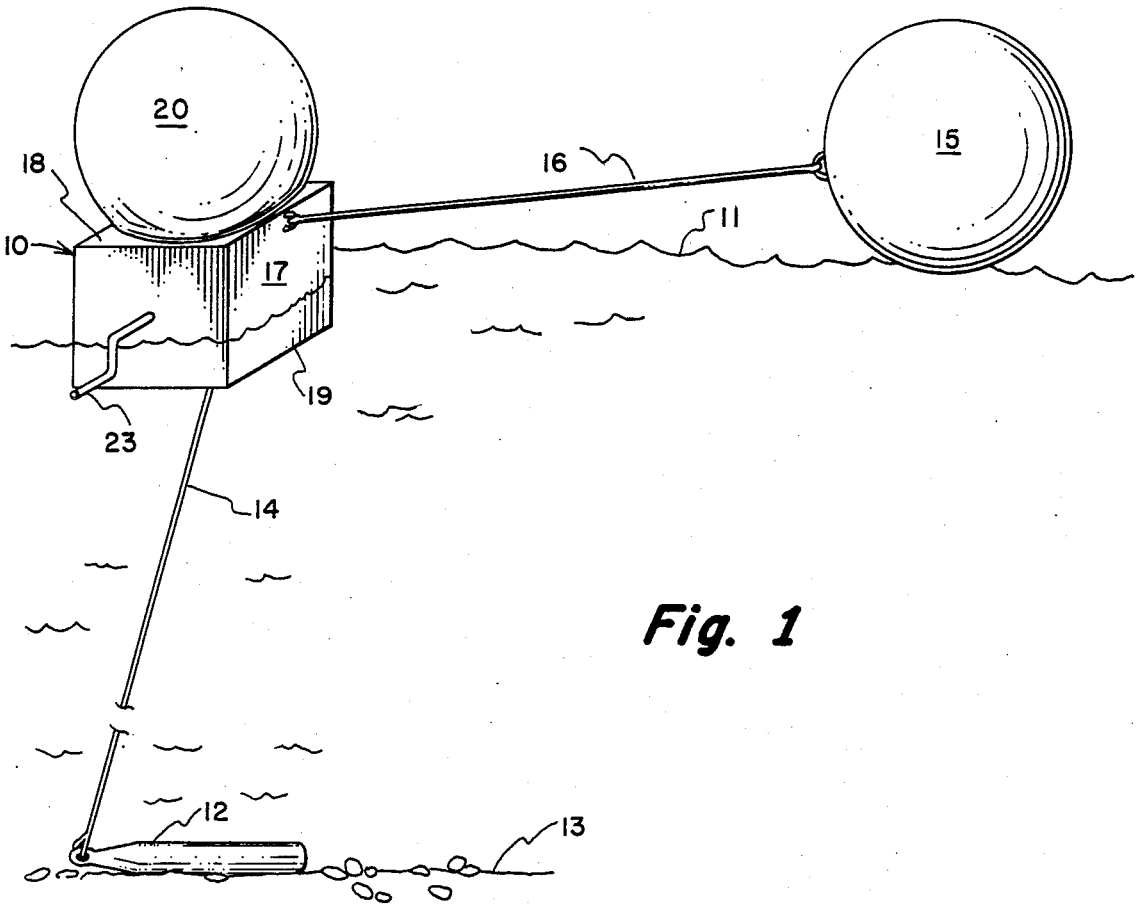
FIG. 1 is a side view showing an embodiment of the apparatus of this invention in its deployed state.
Figure 2:
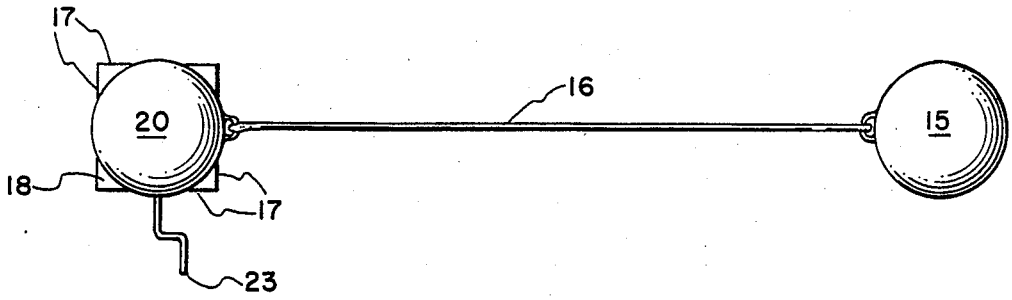
FIG. 2 is a top view of the apparatus of FIG. 1.
Figure 3:
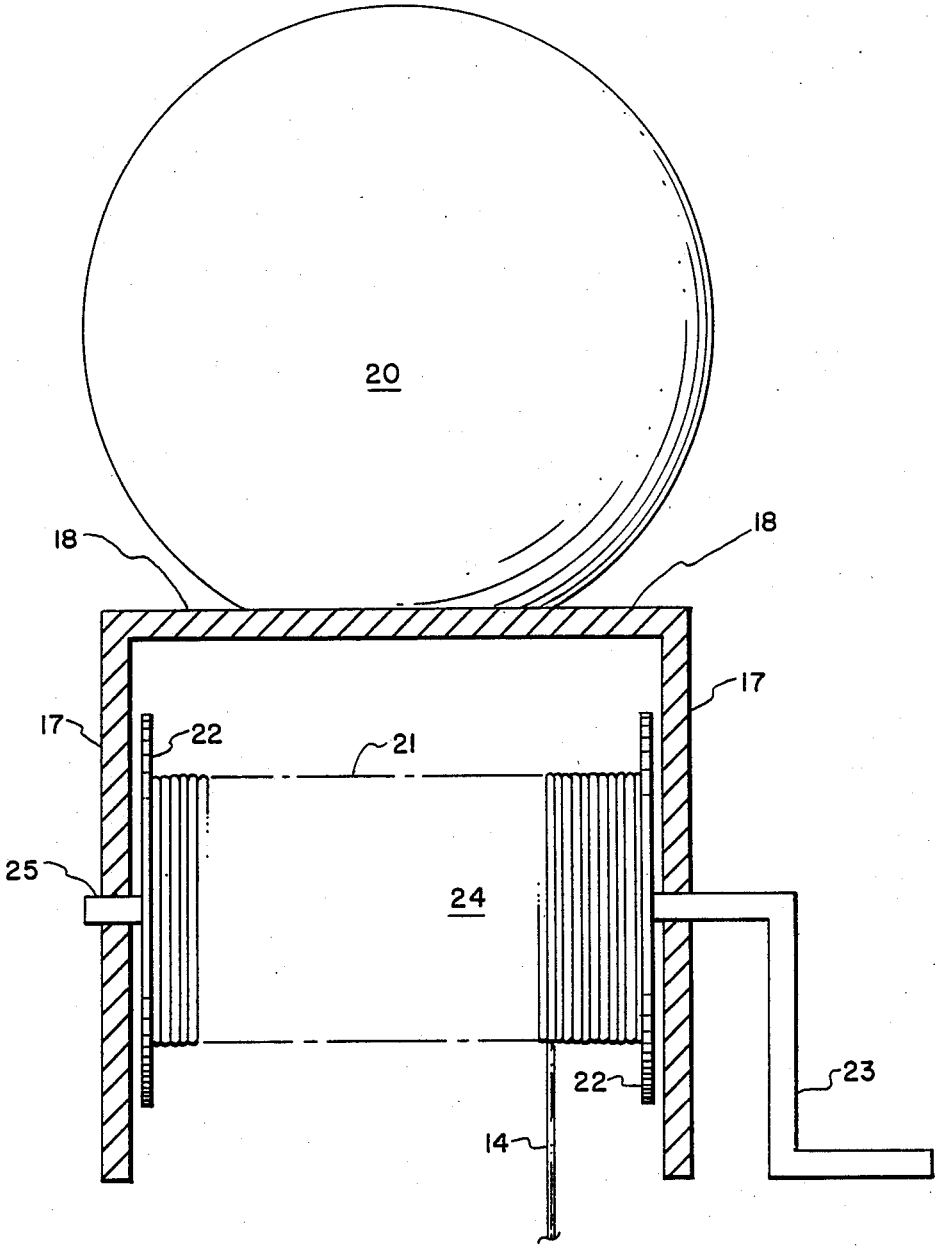
FIG. 3 is an enlarged sectional side view of the floating reel member of the apparatus of FIG. 1.

Referring to the drawing, an embodiment of the apparatus of this invention is shown comprised of floating reel member 10 shown floating upon the surface 11 of a body of water, weight 12 resting upon the bottom 13 of the body of water at the end of line 14, and current-indicating buoy 15 attached by tether line 16 to said reel member.

The illustrated reel member is comprised of housing 19 fabricated of impact-resistant plastic in a box-like configuration comprised of side panels 17 and top panel 18. The housing may be of monolithic construction as may be produced by a molding operation. The panels may typically be 7 inches high and 7 inches wide. A spherical flotation sphere 20 is affixed to top panel 18. Said sphere may be fabricated of a closed cell foam of a plastic such as polystyrene and may typically be of 7 inch diameter and bright color to facilitate visual observation. Other flotation means may, however, be employed in association with the housing.

A spool 21 having flanges 22, core 24, and axle 25 is rotatably journalled to opposing side panels 17 and positioned to rotate about a horizontal axis. Said flanges are closely spaced from the interior surfaces of said side panels. A crank handle 23 constructed as a continuous extension of the axle is adapted to manually rotate said spool. A continuous length of line 14, preferably a monofilament line of about 120 pound test, is attached at one end to the spool and spirally wound upon core 24 in a uniform and readily unwindable manner. The line has a length preferably in the range of about 200 to 600 feet. Core 24 preferably has a diameter between about 3 and 5 inches.

A weight 12 of streamlined elongated contour is attached to the free extremity of line 14. The weight is preferably between about 3 and 8 pounds.

A current-indicating buoy 15 is attached by tether line 16 to housing 19. The buoy may be of spherical configuration, having a diameter between about 5 and 10 inches, and preferably having a highly distinctive color. Tether line 16 may range in length between about 5 and 15 feet.

The entire apparatus is substantially compact and easy to deploy from the stored state. Deployment is achieved simply by throwing the apparatus into the water at the exact site where it is desired to position the boat. The weight immediately descends to the bottom. Frictional factors in the reel construction prevent excess line from unwinding from the spool. The buoy orients itself with respect to the floating reel in a direction based upon wind, current and tide. By observing the positions of the buoy and the reel, the boat operator knows where to drop the boat anchor and knows what position the boat should be in at the instant the anchor is dropped. The apparatus is easily retrieved and the line is hand-wound by means of crank handle 23 back onto the spool.

While particular examples of the present invention have been shown and described, it is apparent that changes and modifications may be made therein without departing from the invention in its broadest aspects.

The aim of the appended claims, therefore, is to cover all such changes and modifications as fall within the true spirit and scope of the invention.

Having thus described my invention, what is claimed is:

1. An apparatus for aiding the anchoring of a boat upon the bottom of a body of water comprising:

(a) a floating reel member comprising a housing having a top portion and sidewall portions, a doubly flanged spool mounted in said sidewall portions and positioned to rotate about a horizontal axis, a continuous length of line attached to said spool and spirally wound thereupon, a crank handle protruding from said sidewall portions and extending to operative engagement with said spool, and visibly distinctive flotation means mounted upon said top portion, (b) a weight having a streamlined elongated contour attached to the free extremity of said line and sufficiently heavy to cause rapid deployment of said line from said spool when said weight descends from the surface of said body of water to the bottom thereof, and (c) a visibly distinctive current-indicating buoy attached to said housing by a tether of 5–15 foot length.

2. The apparatus of claim 1 wherein said line is of monofilament construction.

3. The apparatus of claim 1 wherein the spool is mounted to said housing in a manner to have an amount of frictional resistance to rotation which permits said weight in the course of its fall to said bottom to rotate said spool, but which prevents further rotation of the spool once said weight is resting on the bottom.

4. The apparatus of claim 1 wherein said housing is constructed of bouyant material.

* * * * *